US006049912A

United States Patent [19]

Linehan

[11] Patent Number: 6,049,912

[45] Date of Patent: Apr. 18, 2000

[54] MOUNTABLE PRINTABLE PLACARD WITH HEADBAND

[76] Inventor: Timothy J Linehan, 360 Plymouth St., West Hempstead, N.Y. 11552

[21] Appl. No.: 09/221,443

[22] Filed: Dec. 28, 1998

[51] Int. Cl.[7] ..... A42B 1/24

[52] U.S. Cl. ..... 2/209.13; 2/171; 2/244; 2/DIG. 11; 40/329; 132/275

[58] Field of Search ..... 2/171, 209.13, 2/244, 246, DIG. 11; 40/329; 132/273, 275; D2/865, 869, 891, 895

[56] References Cited

U.S. PATENT DOCUMENTS 5,427,123 6/1995 Odenthal ..... 132/275

*Primary Examiner*—Diana Oleksa
*Attorney, Agent, or Firm*—Michael I Kroll

[57] ABSTRACT

The present invention 10 discloses a resilient headband 14 arcuate in shape for being mounted on the head of the user 12. The headband 14 is equipped with a longitudinal slotted member 16 for holding a placard 18 therein, in a generally upright standing manner which placard 18 can have written thereon on one side a thought balloon 19 and on the opposite side a speech balloon 19. The slotted member 16 is equipped with teeth-like holding appendages 22 which grasp the placard 18 and secure it to the slotted member 16.

14 Claims, 6 Drawing Sheets

MOUNTABLE PRINTABLE PLACARD WITH HEADBAND

BACKGROUND OF THE INVENTION

1. Field of the Invention

The present invention relates generally to party goods and, more specifically, to a two sided printable placard having some phrase enclosed within a speech balloon printed on the front and some phrase printed on the backside of the placard enclosed within a thought balloon. The placard is placed into a headband having a longitudinal slot for the placement thereof.

2. Description of the Prior Art

There is other headwear designed for party use. Typical of these is U.S. Pat. No. Des. 283,233 issued to Horwitz on Apr. 1, 1986.

Another patent was issued to Hoeflich on May 1, 1962 as U.S. Pat. No. 3,031,681. Yet another U.S. Pat. No. 3,249,948 was issued to Eppolito on May 10, 1966 and still yet another was issued on Feb. 8, 1994 to Rivera as U.S. Pat. No. Des. 343,945.

This United States patent discloses an ornamental design for a novelty headband as illustrated in the drawings of the patent.

This United States patent discloses a tiara-like headband for use at parties, said device comprising a resilient arcuate band curved about a generally horizontal axis which extends in the direction of the width of the band, an upstanding ornament, and a covering for said band, said band comprising metal foil having an initial width greater than the band width in the direction of the aforesaid horizontal axis and reversely folded at the side edges of the band, one or more strands of thin resilient wire running lengthwise of the band and frictionally locked inside the reversely folded foil, said wire being curved with said foil, said ornament being permanently secured to the band with the ornament carried upright by the band in a plane generally perpendicular to the aforesaid axis of the band.

This United States patent discloses a disposable cap which covers all of the hair of the wearer wherein said cap comprises a crown portion and an integral side portion folded over from the perimeter of the crown; an elastic band attached to a lower edge of part of the side portion along the sides and back thereof; an integral quadrilateral section folded over from the front part of the crown and comprising one portion contiguous with said crown and an outer portion folded back into the interior of said cap; and seams attaching the sides of said one portion and said outer portion of said quadrilateral section to contiguous edges of the side portion to stiffen said quadrilateral section and to form a pocket with an upwardly facing mouth inside the cap between said outer portion and the inner surface of said one portion.

This United States patent discloses an ornamental design for a hat as illustrated in the drawings of the patent.

While these headwear designs for party use may be suitable for the purposes for which they were designed, they would not be as suitable for the purposes of the present invention, as hereinafter described.

SUMMARY OF THE PRESENT INVENTION

The present invention discloses a resilient headband arcuate in shape for being mounted on the head of the user. The headband is equipped with a longitudinal slotted member for holding a placard therein, in a generally upright standing manner which placard can have written thereon on one side a thought balloon and on the opposite side a speech balloon. The slotted member is equipped with teeth-like holding appendages which grasp the placard and secure it to the slotted member.

A primary object of the present invention is to provide novelty headwear for party use.

Another object of the present invention is to provide novelty headwear having a placard with a speech balloon imprinted on one side and a thought balloon imprinted on the backside.

Yet another object of the present invention is to provide novelty headwear having a placard having one or more phrases targeting a special occasion imprinted within the speech balloon on the front side and one or more phrases imprinted within the thought balloon on the backside.

Still yet another object of the present invention is to provide novelty headwear having a placard whereupon one or more phrases targeting a special occasion can be printed by an individual within the speech balloon on the front side and one or more phrases can be printed by an individual within the thought balloon on the backside.

Yet another object of the present invention is to provide novelty headwear having a headband with a longitudinal slot wherein the aforesaid placard can be placed in a generally perpendicular position to the headband.

Additional objects of the present invention will appear as the description proceeds.

The present invention overcomes the shortcomings of the prior art by providing novelty headwear comprising a headband having a longitudinal slot for the placement of a placard having a speech balloon printed on one side wherein one or more phrases can be imprinted or handprinted by an individual targeting a special occasion and where the said placard has a thought balloon printed on the back side whereupon one or more phrases can be imprinted or handprinted by an individual.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
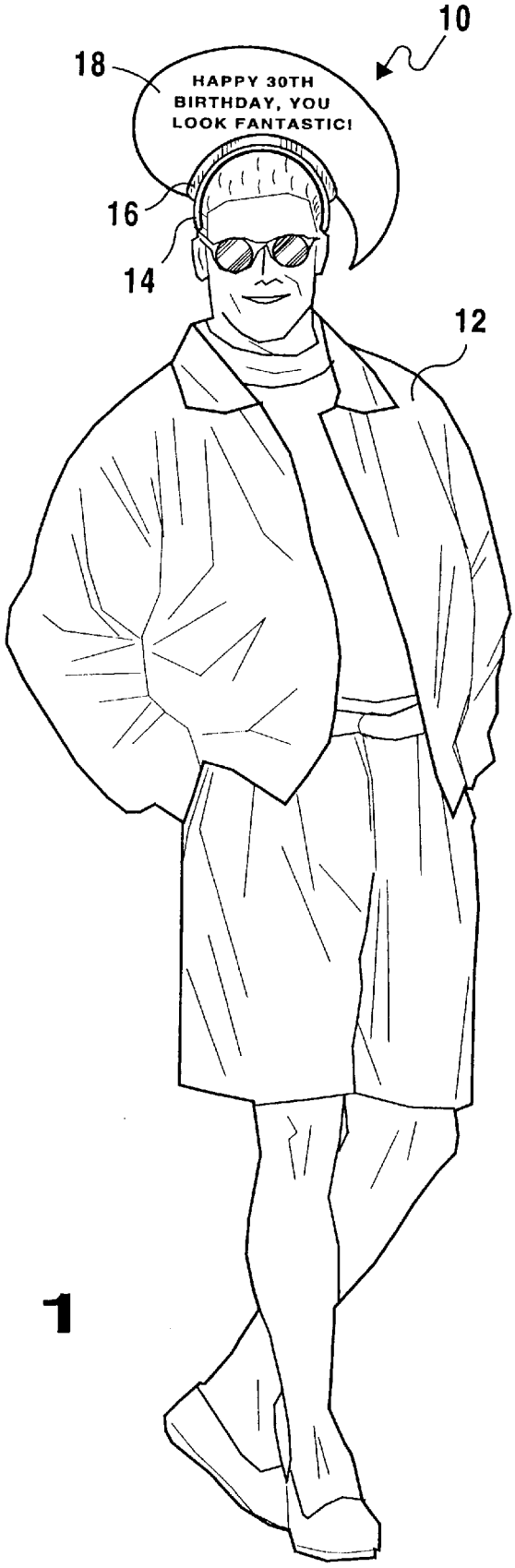
FIG. 1 is a perspective view of the present invention in use whereby an individual is provided with party headwear having one or more phrases targeting a special occasion.

With regard to the reference numerals used, the following numbering is used throughout the various figures.

10 present invention

12 user

14 headband

16 slotted member

18 placard

19 balloon

20 slot

22 teeth

DESCRIPTION OF THE PREFERRED EMBODIMENT(S)

Turning now descriptively to the drawings, in which similar reference characters denote similar elements throughout the several views, FIGS. 1 through 10 illustrate the present invention being a headband having an upright standing placard thereon.

Turning to FIG. 1, therein is shown a perspective view of the present invention 10 in use whereby an individual 12 is provided with party headwear having one or more phrases targeting a special occasion. Shown therein is the resilient, flexible, arcuate headband 14 of the present invention having mounted thereon a slotted member 16 whereupon upstanding placards 18 having messages written thereon can be placed. The placards have a front and rear side upon which both can be written with phrases.

Figure 2:
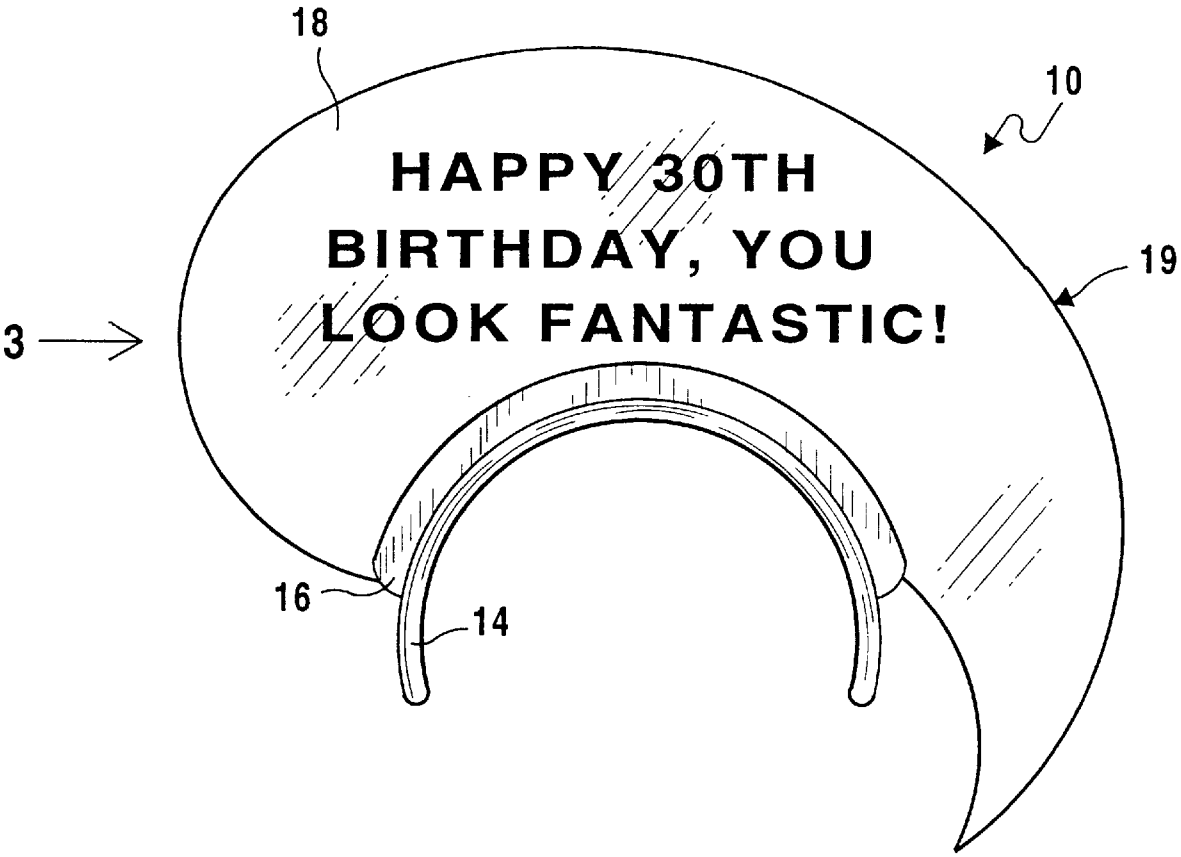
FIG. 2 is a front elevational view of the present invention. Shown is a headband having a longitudinal slot with a placard contained therein in a generally perpendicular orientation to the headband.

Turning to FIG. 2, therein is shown a front elevation view of the present invention 10. Shown is the headband 14 having a longitudinal slot 16 with a placard 18 contained therein in a generally perpendicular orientation to the headband 14. Written upon the placard is a speech message contained in a speech balloon 19.

Figure 3:
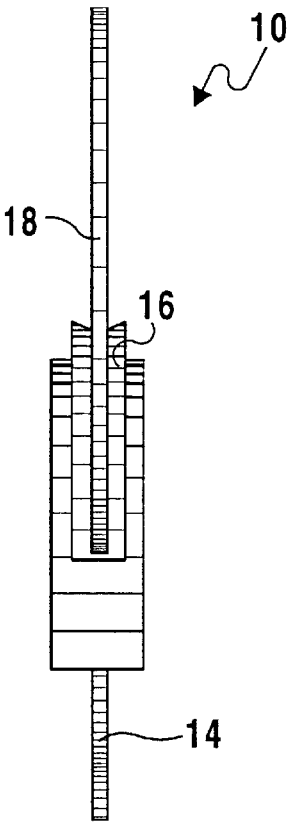
FIG. 3 is a side elevation view of the present invention. Shown is a headband having a longitudinal slot with a placard contained therein in a generally perpendicular orientation to the headband.

Turning to FIG. 3, therein is shown a side elevation view of the present invention 10. Shown is the headband 14 having a longitudinal slot 16 member thereon with a placard 18 frictionally held within the slot 16 in a generally perpendicular orientation to the headband 14.

Figure 4:
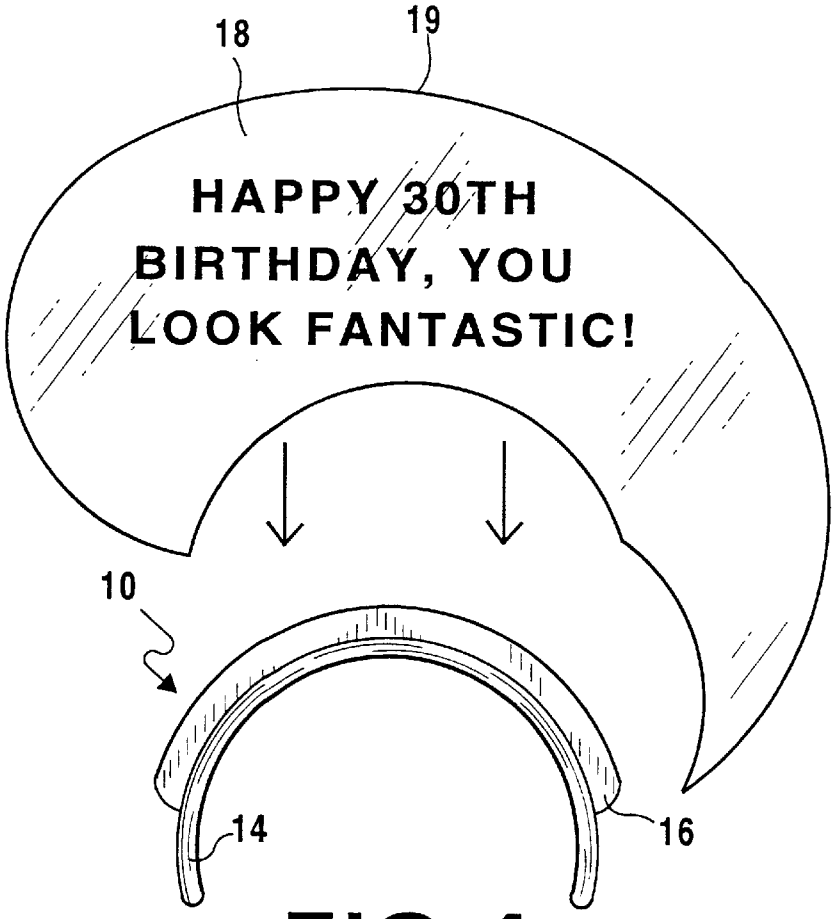
FIG. 4 is an exploded front view of the present invention. Shown is a headband with a placard having one or more phrases targeting a special occasion imprinted within a speech balloon ready to be inserted into a longitudinal slot contained within the headband.

Turning to FIG. 4, therein is shown an exploded front view of the present invention 10. Shown is the headband 14 with a placard 18 having one or more phrases targeting a special occasion imprinted within a speech balloon 19 ready to be inserted into the longitudinal slot 16 contained within the headband 14.

Figure 5:
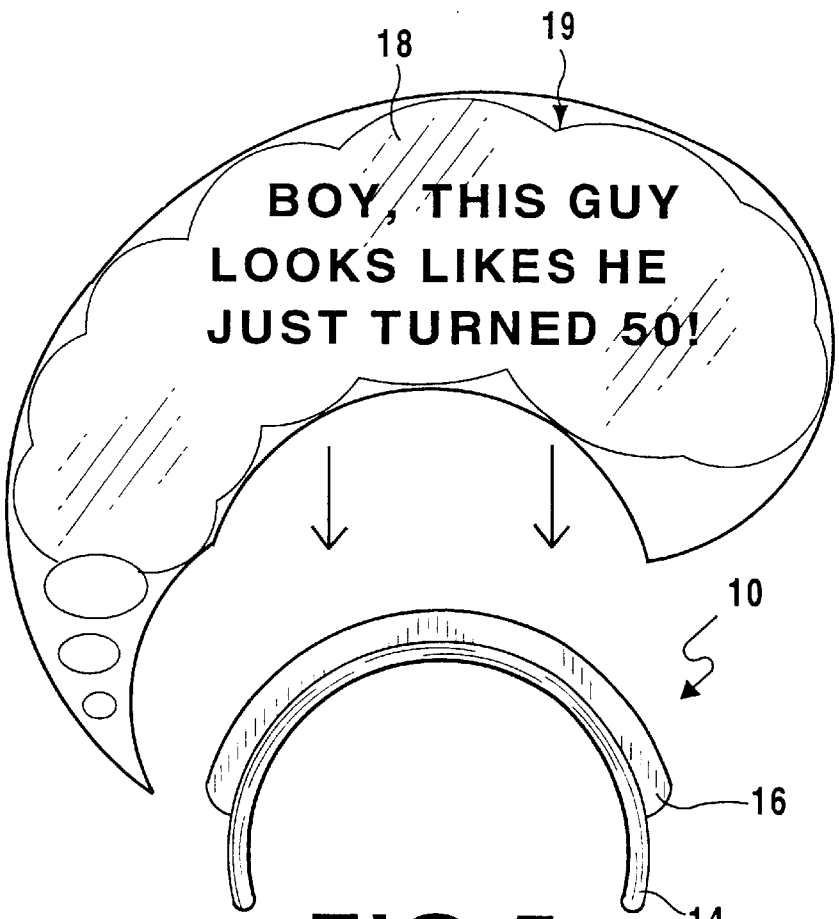
FIG. 5 is an exploded rear view of the present invention. Shown is a headband with a placard having one or more phrases targeting the special occasion imprinted on the front side, imprinted within a thought balloon ready to be inserted into a longitudinal slot contained within the headband.

Turning to FIG. 5, therein is shown an exploded rear view of the present invention 10. Shown is the headband 14 with a placard 18 having one or more phrases targeting a special occasion imprinted within a thought balloon 19 for it to be inserted into the longitudinal slot 16 contained within the headband 14.

Figure 6:
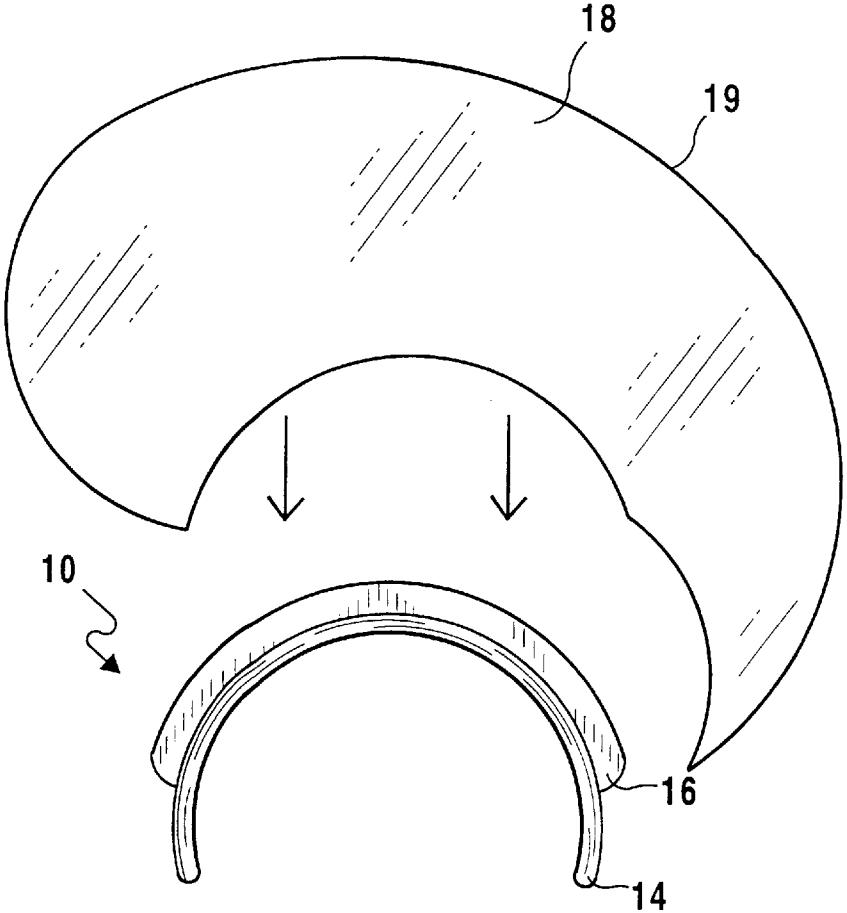
FIG. 6 is an exploded front view of the present invention. Shown is a headband with a placard having a speech balloon whereupon an individual can print one or more phrases targeting a special occasion and insert said placard into the longitudinal slot contained within the headband.

Turning to FIG. 6, therein is shown an exploded front view of the present invention 10. Shown is the headband 14 with a placard 18 which could have one or more phrases targeting a special occasion imprinted within a speech balloon 19 for it to be inserted into the longitudinal slot 16 contained within the headband 14.

Figure 7:
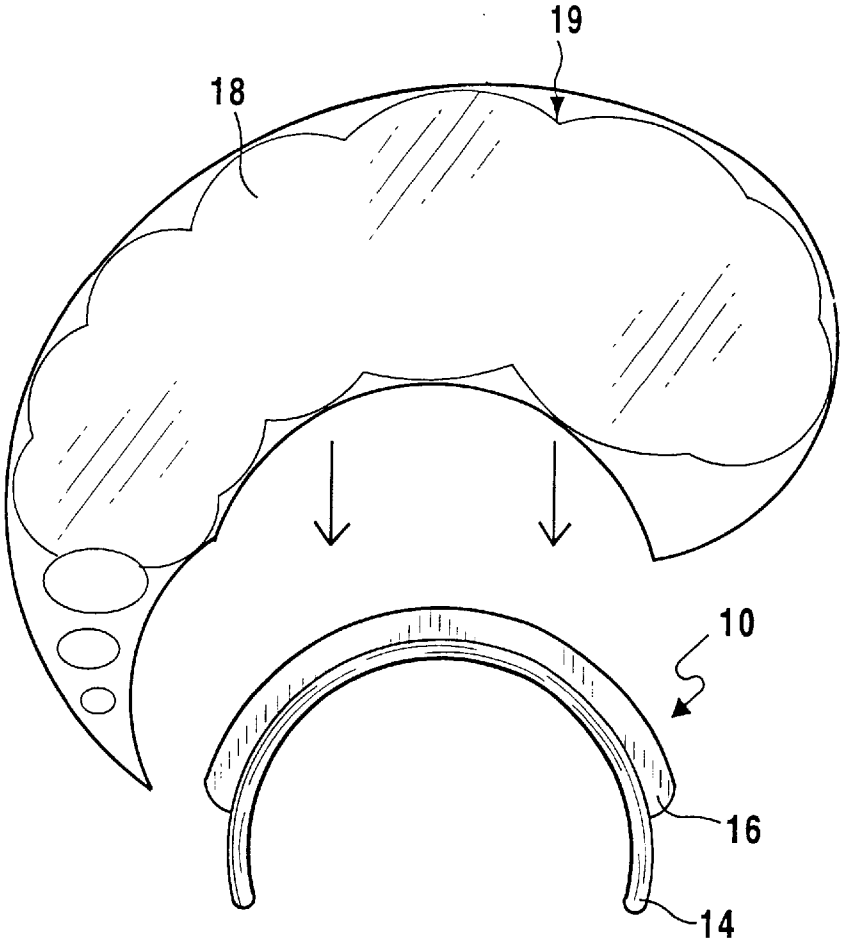
FIG. 7 is an exploded back view of the present invention. Shown is a headband with a placard having a thought balloon whereupon an individual can print one or more phrases targeting the special occasion referred to on the front side and insert said placard into the longitudinal slot contained within the headband.

Turning to FIG. 7, therein is shown an exploded back view of the present invention 10. Shown is the headband 14 with a placard 18 which could have one or more phrases targeting a special occasion imprinted within a speech balloon 19 for it to be inserted into the longitudinal slot 16 contained within the headband 14.

Figure 8:
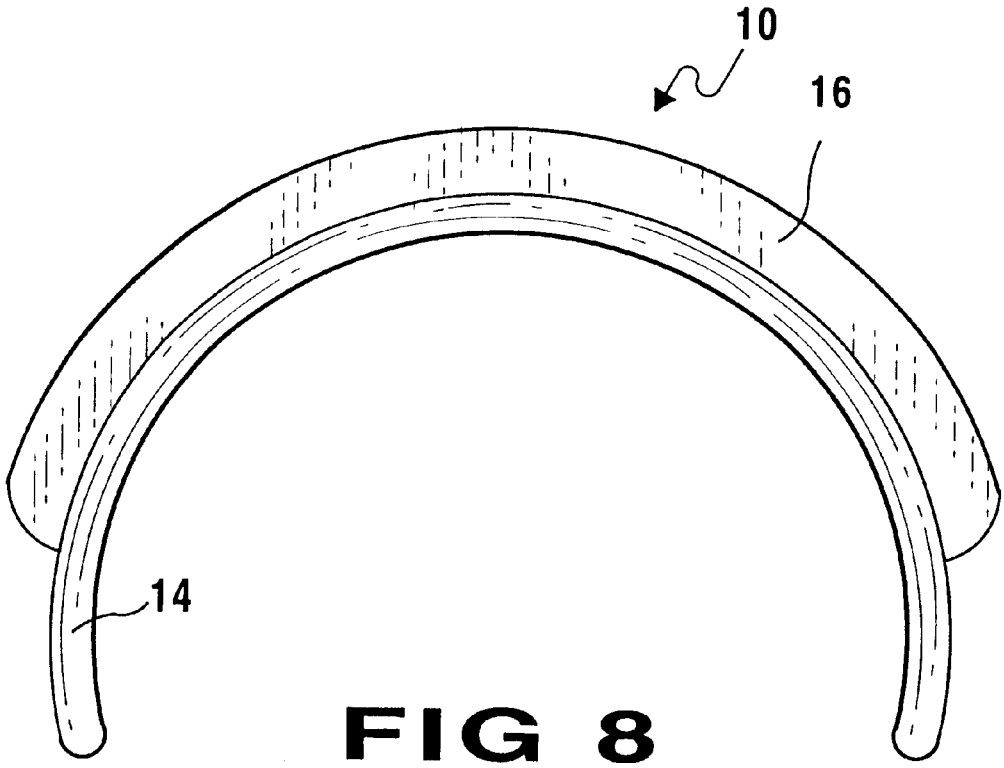
FIG. 8 is a front elevational view of the headband of the present invention.

Turning to FIG. 8, therein is shown a front elevational view of the headband 14 of the present invention 10. Also shown is the slot member which runs around the outside length of the headband 14 for holding the placard.

Figure 9:
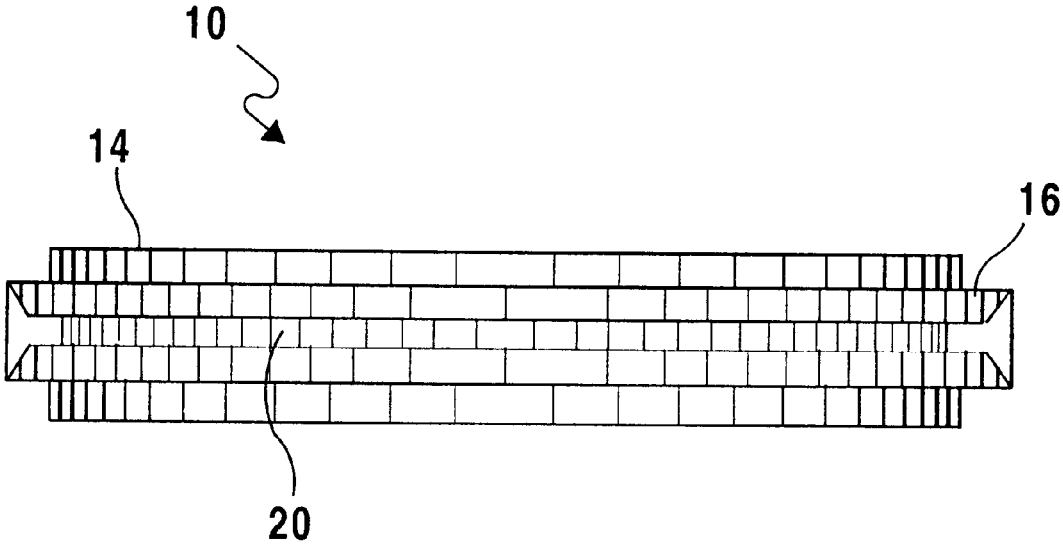
FIG. 9 is a top plan view of the headband of the present invention. Shown is the headband having a longitudinal slot contained therein.

Turning to FIG. 9, therein is shown a top plan view of the headband 14 of the present invention 10. Also shown is the headband 14 having a longitudinal slot member 16 contained thereon. Note that the slot member 16 has located there on a slot 20 for placement therein of the placard (not shown).

Figure 10:
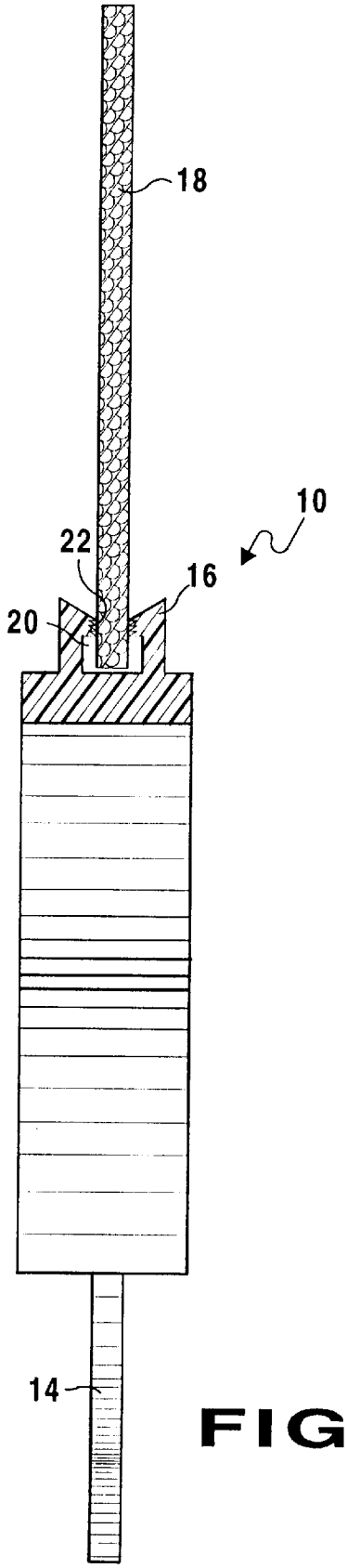
FIG. 10 is a cross section of the present invention. Shown is a headband having a longitudinal slot with a placard contained therein in a generally perpendicular orientation to the headband.

Turning to FIG. 10, therein is shown a cross section of the present invention 10. Shown is a headband 14 having a longitudinal slot member 16 with a placard 18 contained therein in a generally perpendicular orientation to the headband 14. Also shown is the slot 20 having downward projecting teeth 22 thereon for positively, frictionally gripping and holding therein the placard 18.

What is claimed is new and desired to be protected by Letters Patent is set forth in the claims:

1. A device for holding a placard, comprising:

a) a headband;

b) said headband having a slotted member;

c) said slotted member having a slot contained therein;

d) a placard containing a party slogan mounted in said slot; and, e) said party slogan being contained in a ballon, wherein said slotted member further comprises teeth like appendages for grasping said placard.

2. The apparatus of claim 1, wherein said headband is arcuate in shape for attachment to the head of the user.

3. The apparatus of claim 2, wherein said headband further comprises resilient material.

4. The apparatus of claim 3, wherein said headband further comprises flexible material.

5. The apparatus of claim 1, wherein said placard is generally upright standing.

6. The apparatus of claim 5, wherein said placard is generally perpendicular to said headband.

7. The apparatus of claim 1, wherein said teeth like appendages are downward pointing whereby said placard is securely held.

8. The apparatus of claim 1, wherein said slotted member runs longitudinally along said headband.

9. The apparatus of claim 1, wherein said placard has a first front side and a second back side, said balloon being imprinted on said first front side and further including a second balloon imprinted on said second back side thereof.

10. The apparatus of claim 9, wherein said slogan in said balloon is preprinted.

11. The apparatus of claim 9, wherein said slogan in said balloon is handwritten.

12. A device for holding a placard, comprising:

a) a headband;

b) said headband having a slotted member;

c) said slotted member having a slot contained therein;

d) a placard containing a party slogan mounted in said slot; and, e) said party slogan being contained in a ballon, wherein said placard is frictionally held in said slot.

13. A device for holding a placard, comprising:

a) a headband;

b) said headband having a slotted member;

c) said slotted member having a slot contained therein;

d) a placard containing a party slogan mounted in said slot; and, e) said party slogan being contained in a ballon, wherein said slotted member runs longitudinally along said headband and said placard is frictionally held in said slotted member.

14. The apparatus of claim 13, wherein said slotted member further comprises teeth like appendages being downward pointing whereby said placard is securely held.

* * * * *